US006155732A

United States Patent [19]

Plasschaert et al.

[11] Patent Number: 6,155,732

[45] Date of Patent: Dec. 5, 2000

[54] LINERLESS LABEL MEDIA CUTTING MECHANISM

[75] Inventors: Paul E. Plasschaert, Orlando, Fla.; Charles E. Jondal, Jordan, Minn.

[73] Assignee: Datamax Corporation, Orlando, Fla.

[21] Appl. No.: 09/335,814

[22] Filed: Jun. 18, 1999

Related U.S. Application Data

[60] Provisional application No. 60/091,940, Jul. 7, 1998.

[51] Int. Cl.[7] ..... B41J 11/70

[52] U.S. Cl. ..... 400/621

[58] Field of Search ..... 400/621, 621.1, 400/621.2; 101/288, 226; 83/169

[56] References Cited

U.S. PATENT DOCUMENTS

| | | | |
|---|---|---|---|
| 2,780,288 | 2/1957 | Wharton et al. | 83/93 |
| 5,271,789 | 12/1993 | Takagi et al. | 400/621 |
| 5,524,996 | 6/1996 | Carpenter et al. | 400/621 |
| 5,560,293 | 10/1996 | Boreali et al. | 101/288 |
| 5,725,320 | 3/1998 | Austin et al. | 400/642 |
| 5,746,527 | 5/1998 | Nebashi et al. | 400/621 |
| 5,883,380 | 11/1998 | Hosomi et al. | 400/621 |
| 5,954,438 | 9/1999 | Klein et al. | 400/621 |
| 5,971,639 | 10/1999 | Park | 400/621 |

*Primary Examiner*—Stephen R. Funk
*Attorney, Agent, or Firm*—Dilworth & Barrese

[57] ABSTRACT

A linerless label media cutting apparatus adapted for receiving linerless label media from a printer is provided. The apparatus includes a cutting assembly and a cutter mount. The cutting assembly has a first cutting blade and a second cutting blade that cooperate to sever at least one label. The cutter mount supports the cutting assembly and is mountable to the printer. A drive actuator assembly may be included. The cutter mount may include mounting structure to facilitate mounting and alignment to the printer. The cutter mount may also include a blade carrier and base plate for supporting the cutting blades. The base plate may define a cavity for receipt of linerless label media. The apparatus may also include a blade lubricator. In an alternate embodiment, the apparatus includes an input guide for guiding linerless label media travel. The input guide may be plasma coated. A method for preparing labels is disclosed.

20 Claims, 2 Drawing Sheets

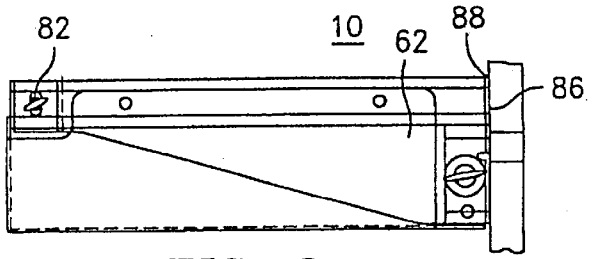
FIG. 2
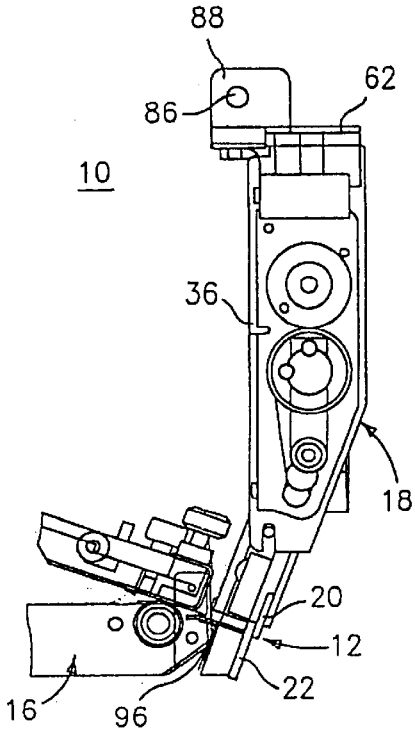
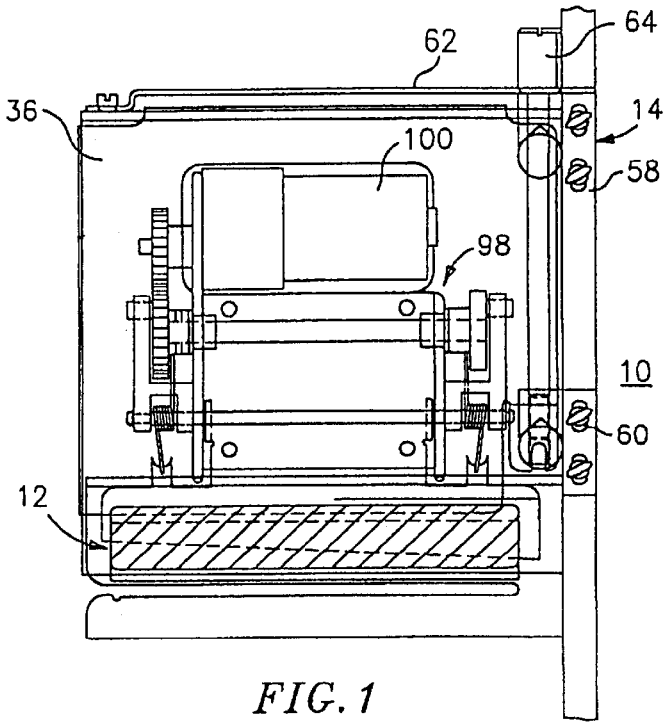
FIG. 1
FIG. 4
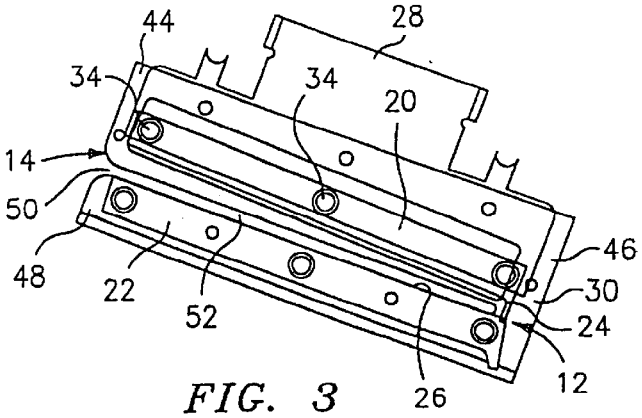
FIG. 3

LINERLESS LABEL MEDIA CUTTING MECHANISM

CROSS REFERENCE TO RELATED APPLICATION

This application claims priority to U.S. Provisional Application Ser. No. 60/091,940 filed Jul. 7, 1998 by Paul E. Plasschaert and Charles E Jondal, the entire contents of which are hereby incorporated by reference.

BACKGROUND

1. Technical Field

This disclosure relates, generally, to linerless label media printing apparatus and, more particularly, to linerless label media cutting mechanisms for severing and presenting label media.

2. Description of Related Art

In the label media printing industry, efficiency requires that printed labels are created using printing apparatus that is reliable, requires minimal maintenance and is facile in operation. Conventionally, label media are introduced to a printer on a continuous strip of thin liner paper that carries individually die cut labels to be printed on. The labels are adhesively attached to the liner paper. Subsequent to printing, each label is separated from the liner paper and presented to an applicator that transfers the label to an article.

The liner paper remaining after printing is extremely wasteful and a need emerged for linerless label media. Linerless label media is known and available in roll form, similar to a roll of tape or the like.

Printers are also known that are adapted for printing linerless label media. These may include printers specifically dedicated for use with linerless label media or printers including a modified conventional cutting device. Typically, a conventional cutting device is modified for severing linerless label media. The internal workings of the printer are adapted so that adhesive from the label media will not adhere to the printer's mechanical parts. In operation, the printer presents the printed label media to the modified cutting device which, in turn, presents the label to an applicator. The applicator is adapted to accommodate the modified cutting device.

Some linerless label media dedicated devices include a linerless label media printer disclosed in U.S. Pat. No. 5,524,996. In operation, the printer advances the printed portion past a standard cutting blade. U.S. Pat. No. 5,560,293 discloses a thermal printer for printing linerless labels utilizing a conventional cutter. U.S. Pat. No. 5,725,320 discloses a linerless media and cutter having a cutter station comprising a plurality of cutting assemblies which extend radially and rotate about a wheel.

The aforementioned devices require a printer exclusively dedicated for use with linerless label media or require a high degree of modification to an existing printer for accommodating linerless label media. These modifications disadvantageously involve disruption of the printer's components.

Another disadvantage of the conventional cutter is that access to the internal workings of the printer, for maintaining and loading the printer with linerless label media, is prohibitive. Most conventional cutters require media loaded into an opening in the reverse direction that the label media is presented to the cutter from the printer. This requires a roll of media to be threaded blindly into a printer, of ten resulting in a misfeed.

Yet another disadvantage of the prior art is that the cutting blades of a conventional cutter become gummed rapidly due to the adhesive from linerless label media. The rapid gumming of the cutter blades necessitates frequent maintenance of the cutter resulting in inefficient printing operation.

It is, therefore, an object of the present disclosure to provide a linerless label media cutting apparatus that is easily mounted to an existing printer with a minimal degree of modification to the printer.

It is another object of the present disclosure to provide a cutting apparatus that allows facile access to the internal workings of a printer for loading label media and reduces maintenance requirements. Desirably, such a design provides a cutting mechanism that is adaptable to a linerless label media applicator.

SUMMARY

A linerless label media cutting mechanism is provided for a printer. The linerless label media cutting mechanism includes: a cutter mount for mounting the cutting mechanism to a printer; and a cutter. The cutter may be supported by a cutter carrier. The cutting mechanism may further comprise a guide means for guiding the label media through the cutter mechanism and a drive actuator for actuating the cutting mechanism. Desirably, a lubricating means is attachable to the cutter carrier for lubricating, inter alia, the cutting blade(s).

In one embodiment, a linerless label media cutting apparatus is disclosed which is adapted for receiving linerless label media from a printer. The apparatus includes a cuffing assembly having a first cutting blade and a second cutting blade. The first and second cutting blades cooperate to sever at least one label from the linerless label media. The first cutting blade and the second cutting blade can also sever a plurality of labels from linerless label media. The second cutting blade may have a blade lubricator mounted thereto which can comprise, for example, a sponge or foam pad. The blade lubricator is configured to lubricate the cutting blades. The blade lubricator may be biased against the first cutting blade. Desirably, the lubricator includes silicone.

A cutter mount supports the cutting assembly and is mountable to the printer. The cutter mount may include mounting structure configured for mounting the cutter mount to the printer and alignment of the apparatus to the printer. The cutter mount may have a blade carrier for supporting the first cutting blade and a base plate for supporting the second cutting blade. The base plate may comprise a top member, a support member and a cantilever member. The top member and the cantilever member extend longitudinally from the support member in a substantially parallel orientation to define a cavity for receipt of linerless label media. The top member may have a blade lubricator mounted thereto.

The first cutting blade may be actuatable relative to the second cutting blade. The apparatus may include a drive actuator operatively associated with the first cutting blade.

In an alternate embodiment, the linerless label media cutting apparatus includes an input guide mounted to the cutter mount. The input guide is configured for guiding linerless label media. The input guide may include a plasma coating.

A method for preparing labels from linerless label media is disclosed. The method includes the steps of providing linerless label media from a printer to a linerless label media cutting apparatus, providing a linerless label media cutting apparatus adapted for receiving linerless label media from the printer, and severing at least one label from the linerless label media. The method may include the step of presenting the label to a label applicator.

BRIEF DESCRIPTION OF THE DRAWINGS

Various embodiments are described herein with reference to the drawings, wherein:

FIG. 1 is a front plan view of one embodiment of a linerless label media cutting apparatus in accordance with the present disclosure;

FIG. 2 is a top plan view of the embodiment shown in FIG. 1;

FIG. 3 is a front view of one embodiment of the cutter mount shown in FIG. 1;

FIG. 4 is a side plan view of the embodiment shown in FIG. 1; and

DETAILED DESCRIPTION OF EXEMPLARY EMBODIMENTS

Figure 5:
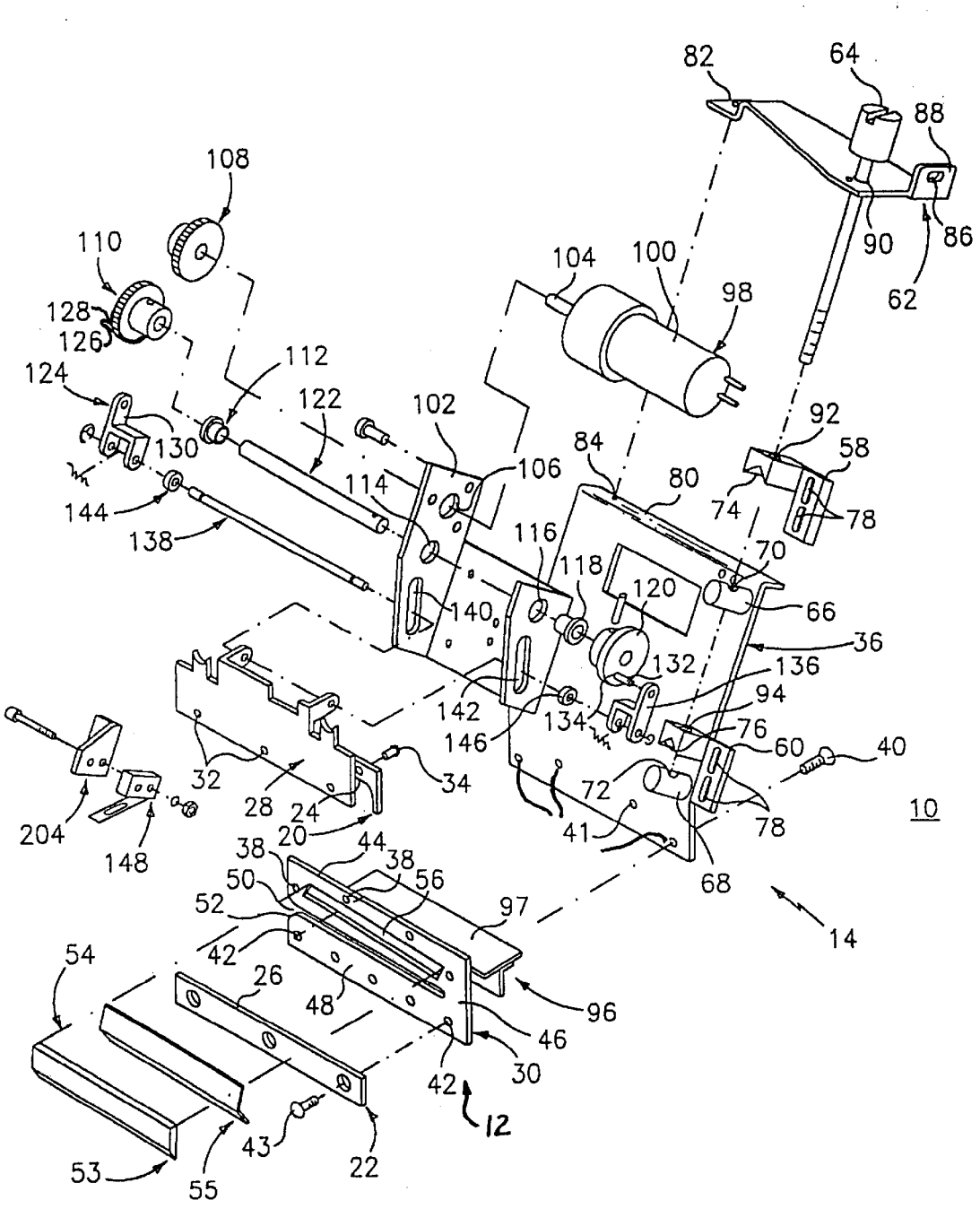
FIG. 5 is a perspective view with parts separated of the embodiment shown in FIG. 1.

Referring now in detail to the drawings wherein like reference numerals identify similar or like reference numerals throughout the several views, FIG. 1 illustrates one embodiment of a linerless label media cutting apparatus, in accordance with the present invention. The cutting apparatus is adapted for receiving linerless label media from a printer and is easily mounted to the printer with a minimum degree of modification to the printer. The easily mountable cutting apparatus avoids disruption of the printer's components.

The linerless label media cutting apparatus, designated generally by numeral 10, includes a cutting assembly 12 and cutter mount 14. Cutter mount 14 supports cutting assembly 12 and is mountable to a printer.16, as shown in FIG. 4. A cover 18 encloses cutting apparatus 10 for potential safety requirements and to prevent dust, dirt and undesirable elements from interfering with the components of cutting apparatus 10. It is contemplated that cover 18 may completely enclose the components of cutting apparatus 10, however, it is envisioned that only portions of the cutting apparatus may be enclosed due to the particular printing application and/or cost constraints, including space limitations. Cover 18 is, preferably, fabricated from sheet metals, such as, for example, aluminum or steel, but it is contemplated that suitable polymeric materials may be used including plastics, rubbers, resins, etc. The cover may be transparent so that the components of apparatus 10 may be viewed.

As shown in FIGS. 3–5, cutting assembly 12 includes a first cutting blade, such as, for example, upper blade 20 and a second cutting blade, such as, for example, lower blade 22. Upper blade 20 and lower blade 22 cooperate to sever at least one label from linerless label media (not shown). It is contemplated that blades 20 and 22 may sever a plurality of labels in a sequential manner as linerless label media travels through apparatus 10.

Referring to FIG. 5, each of blades 20 and 22 define sharpened edges 24 and 26, respectively. The sharpened edges cooperate to sever labels. It is contemplated that only one blade may include a sharpened edge and the remaining blade has a blunt edge, depending on the printing application. Blades 20 and 22 are fabricated from a material that is suitable for severing linerless label media, such as, for example, hardenable A2 tool steel. It is contemplated that the tool steel is hardened to a Rockwell hardness of Rc60.

Referring to FIG. 3, upper blade 20 is actuatable relative to lower blade 22 for severing labels. Lower blade 22 is fixedly supported by cutter mount 14 and upper blade 20 is operatively associated with a drive actuator, as will be discussed hereinbelow. The drive actuator causes movement of upper blade 20 relative to lower blade 22, causing the blades to converge for severing labels.

Referring to FIG. 5, cutter mount 14 includes a blade carrier 28 for supporting upper blade 20, and a base plate 30 for supporting lower blade 22. Blade carrier 28 supports upper blade 20 thereby facilitating operative association with the driver actuator for movement relative to lower blade 22 for severing labels, as will be discussed hereinbelow. Blade carrier 28 may be fabricated from metals, polymerics, etc. Openings 32 are defined by blade carrier 28 for receiving screws or bolts 34 for attaching upper blade 20 thereto through openings defined by blade 20. It is contemplated that upper blade 20 may be attached to blade carrier 28 by other suitable means known to one skilled in the art such as, for example, adhesives, clips, etc.

Base plate 30 supports lower blade 22 facilitating its fixed support to a backplate 36 of cutter mount 14. Base plate 30 is fabricated from aluminum. It is envisioned that base plate 30 may be fabricated from other suitable metals and polymerics. Openings 38 are defined by base plate 30 for receiving screws or bolts 40. Openings 38 correspond to openings 41 defined within back plate 36, receiving bolts 40 for attachment of base plate 30 to back plate 36. Openings 42 are defined by base plate 30 for receiving screws or bolts 43 for attaching lower blade 22 thereto through openings defined by blade 22. It is contemplated that base plate 30 may attach to the above components by other suitable means known to one skilled in the art, such as, for example, adhesives, clips, etc.

Referring now to FIGS. 3 and 5, base plate 30 includes a top member 44, a support member 46 and a cantilever member 48. Top member 44 and cantilever member 48 extend longitudinally from support member 46 in a substantially parallel orientation to an open end 50. Top member 44 and cantilever member 48 are spaced apart to define a cavity 52 with support member 46. Open end 50 and cavity 52 facilitate access from the side of apparatus 10 making handling of linerless label media, which can undesirably adhere to the operator or printer components, easy. The easy access provided by the structure of base plate 30 avoids the problems associated with the adhesive media and makes loading convenient and efficient. As shown, open end 50 is positioned at the left side of base plate 30, however, it is contemplated that the open end may also be at the right side.

Referring to FIG. 5, top member 44 has a blade lubricator 54 mounted thereto which includes a pad 53 and a pad raiser 55. Blade lubricator 54 is configured to lubricate blades 20 and 22. Top member 44 defines an elongated slot 56 for receiving pad 53 and pad raiser 55. Pad raiser facilitates support of pad 53 within slot 56. Elongated slot 56 is slanted or angularly configured relative to the orientation of cutter mount 14. The angular orientation of slot 56 advantageously provides an efficient lubrication of the cutting blades.

Lubricator 54 cooperates with upper blade 20 to prevent adhesive buildup from linerless label media on upper blade 20 and lower blade 22. Pad 53 is an elongate rectangularly configured sponge-like or foam pad and contains silicon. Other suitable additives for preventing adhesive buildup are also contemplated for use with lubricator 54. It is contemplated that pad 53 may have other configurations such as, for example, elliptical, or may comprise a plurality of individual pads supported within slot 56. The plurality of pads may include several smaller circular or rectangular pads. Blade lubricator 54 may also include a thin leaf spring (not shown) to maintain or bias pad 53 in engaging contact with upper blade 20. Blade lubricator 54 places a thin film of silicon onto upper blade 20, and its sharpened edge 24, to prevent blades 20 and 22 from becoming gummed due to adhesive buildup from the linerless label media thereby dispensing with the need for frequent maintenance during operation.

Referring back to FIG. 1, cutter mount 14 includes supports 58 and 60, backplate 36, a bracket 62 and a mounting bolt 64. Backplate 36 includes a pair of mounting bars 66 and 68 projecting therefrom (FIG. 5). Bars 66 and 68 are substantially cylindrical and are configured to engage supports 58 and 60, as will be discussed hereinbelow, to support apparatus 10 in cooperation therewith. The bars may, however, have other configurations such as, for example, rectangular, triangular, etc.

Bars 66 and 68 each define openings 70 and 72, respectively, for receipt of mounting bolt 64, as will be described below. Bars 66 and 68 are formed monolithically with backplate 36 and are of sufficient thickness and strength to support apparatus 10. It is envisioned that the bars may be integrally connected to the backplate as separately fabricated components of apparatus 10. Backplate 36 is fabricated from metals such as, for example, steel or aluminum. It is contemplated that suitable polymeric materials may also be used.

As shown in FIG. 4, backplate 36 is in flush engagement with printer 16 for mounting cutting apparatus 10 thereto. It is contemplated that backplate 36 may engage printer in part or be spaced apart therefrom depending on the configuration and dimensions of the printer.

Referring to FIG. 5, supports 58 and 60 each include grooves 74 and 76, respectively, that engage bars 66 and 68, respectively, for support and alignment of apparatus 10 with printer 16. Grooves 74 and 76 are substantially V-shaped to engage and receive the substantially cylindrical configuration of bars 66 and 68. This engagement advantageously provides for facile mounting and alignment of apparatus 10 to printer 16. It is contemplated that the grooves may have other configurations for receipt of the bars which may also be variously configured such as, for example, rectangular, hexagonal, etc.

Supports 58 and 60 define openings 78 for securing the supports and thereby apparatus 10 to printer 16. Openings 78 receive bolts, screws or the like for mounting the apparatus to the printer. It is envisioned that supports 58 and 60 may also be secured to printer 16 by other suitable means, such as adhesives, clips, etc.

Mounting bracket 62 is constructed from a sheet metal or suitable polymeric and engages a lipped portion 80 of backplate 36 facilitating assembly of the components of apparatus 10 and aligmnent with printer 16. As shown in FIG. 2, bracket 62 defines an opening 82 corresponding to an opening 84 of lipped portion 80 for attachment thereof. Bracket 62 defines a slot 86 within an angled portion 88 facilitating attachment and squareness of apparatus 10 relative to printer 16. This bracket design advantageously assembles the components of apparatus 10 and provides for accurate alignment with printer 16 for efficient operation therewith.

As shown in FIG. 5, mounting bolt 64 is received within an opening 90 of bracket 62, openings 70, 72 of bars 58, 60 and openings 92 and 94 of supports 58, 60, to facilitate assembly of cutter mount 14. Bolt 64 is secured via a threaded distal end thereof or by other suitable means, with bar 68 to thereby cause engagement and assembly of the components of apparatus 10, as discussed above. The threaded distal end of bolt 64 may also pass through bar 68 and engage a threaded bolt or the like. It is envisioned that clips, dowels, etc. may also be used to secure the bolt.

An input guide 96 is positioned adjacent cutting assembly 12 and cutter mount 14, facilitating proper travel of linerless label media presented to cutting assembly 12 from printer 16. Input guide 92 is plasma coated so that the media or adhesive will not adhere to the guide.

Input guide 96 has a T-shaped configuration and is positioned between backplate 36 and base plate 30 as media is guided through apparatus 10 for supporting linerless label media travel. A planar portion 97 of input guide 96 is engaged by the media during operation. The guide also facilitates feeding and loading of the media to a printer. It is contemplated that input guide 96 may have other configurations such as, for example, rectangular, triangular, etc.

A drive actuator assembly 98 is operatively associated with upper blade 20. Drive actuator assembly 98 includes an electric drive motor 100. The particular drive motor utilized could be readily built and installed in a device in accordance with the present disclosure by one skilled in the art in light of the description provided herein, therefore, a further detailed explanation of the specification of the drive motor is not provided herein. It is envisioned that other drive actuation means may be used to actuate the cutting blade assembly, such as, for example, manual, pneumatic, etc.

Drive motor 100 is supported by drive support 102, fastened to backplate 36 and enclosed by cover 18 (FIG. 4). Drive motor 100 has a shaft end 104 received in slot 106, defined within support 102, cooperatively engaging a gear 108. Motor gear 108 cooperatively engages a drive gear 110. Drive gear 110 is supported within bushing 112 that rests in a slot 114 defined within support 102. Support 102 defines a slot 116 for supporting bushing 118 oriented opposite bushing 112. Bushing 118 supports a drive cam 120. Bushings 112 and 118 cooperate to support drive shaft 122.

Drive gear 110 and drive cam 120 cooperate with a linkage 124. Linkage 124 engages a pin 126 received within opening 128, defined within drive gear 110.

A linkage 136 engages a pin 132, received within opening 134 defined within drive cam 120. A blade carrier shaft 138 is supported by linkages 130 and 136. Shaft 138 is movable within the cavity defined by slots 140 and 142 within drive support 102. Bearings 144 and 146 support movement of carrier shaft 138 within openings 140 and 142, respectively.

Cutting assembly 12 is operatively associated with drive actuator assembly 98 by attaching blade carrier 28 to blade carrier shaft 138. Micro switch 148, coupled to support 102, by bracket switch mount 204, controls operation of cutting apparatus 10 by cooperating with blade carrier shaft 138 and upon engagement causes actuation of upper blade 20.

In operation linerless label media is loaded to printer 16 through open end 50 of base plate 30. Side access for loading is facilitated by cantilever member 48. The media may be loaded to printer 16 from a roll or the like.

Printer 16 is activated and the linerless label media is printed upon. After a label is printed, linerless label media is provided from printer 16 and presented to apparatus 10 for severing individual labels at distinct locations so that a printed label may be presented to a label applicator (not shown). The printed label media is guided over input guide 96 to apparatus 10. Adhesive and the media is prevented from adhering to input guide 96 due to its plasma coating.

Printer 60 presents the printed media to cutting apparatus 10. Drive motor 100 transmits a torque to shaft end 104 which rotates motor gear 108. Motor gear 108 transmits the torque to drive gear 110 rotating shaft 122 which, in turn, rotates drive cam 120. The rotation of drive gear 110 and drive cam 120 force linkage 124 and connecting rod 136 into a camming motion causing blade carrier shaft 138 to move within slots 140 and 142. Blade carrier shaft 138 cooperates with upper blade 20. Upper blade 20 has a range of movement within slots 140 and 142. Upon upper blade 20 reaching an extended position, a label will have been completely severed from the media strip. The process is repeated for each label severed.

Blade lubricator 54 is disposed within slot 56 for lubrication of the cutting blades. Upper blade 20 contacts pad 53 of blade lubricator 54 during travel within slots 140 and 142. Upon contact with pad 53, a thin film of silicon is disposed onto upper blade 20 and its sharpened edge 24. It is envisioned that during travel, a silicon film may also be disposed on lower blade 22 and its sharpened edge 26.

Therefore, it is understood that various modifications may be made to the embodiments disclosed herein. For example, while specific preferred embodiments of the cutting apparatus have been described in detail, structures that perform substantially the same function in substantially the same way may also be used. For example, the cutting apparatus may be configured so that cutting may be actuated by the printer. Also, it is contemplated that single or multiple cutting blades may be used. Therefore, the above description should not be construed as limiting, but merely as exemplifications of particular embodiments. Those skilled in the art will envision other modifications within the scope and spirit of the present disclosure.

What is claimed is:

1. A linerless label media cutting apparatus comprising:

a cutting assembly having a first cutting blade and a second cutting blade, said first cutting blade and said second cutting blade cooperating to sever at least one label from a linerless label media; and a cutter mount supporting said cutting assembly and being mountable to a printer, wherein said cutter mount includes a base plate for supporting at least one of said first and second cutting blades, said base plate defining a cavity for receipt of said linerless label media.

2. The linerless label media cutting apparatus according to claim 1, said first cutting blade being actuatable relative to said second cutting blade.

3. The linerless label media cutting apparatus according to claim 2, further comprising a drive actuator assembly operatively associated with said first cutting blade.

4. The linerless label media cutting apparatus according to claim 1, wherein said cutter mount includes a blade carrier for supporting said first cutting blade and wherein said base plate supports said second cutting blade.

5. The linerless label media cutting apparatus according to claim 1, further including an input guide mounted to said cutter mount, said input guide configured for guiding linerless label media.

6. The linerless label media cutting apparatus according to claim 5, wherein said input guide includes a plasma coating.

7. The linerless label media cutting apparatus according to claim 1, wherein said cutter mount further includes a bracket that engages at said least one adaptable support and the printer, said bracket configured for aligning said cutting apparatus with the printer.

8. The linerless label media cutting apparatus according to claim 1, wherein said cutter mount includes a plurality of said adaptable supports.

9. A linerless label media cutting apparatus comprising:

a cutting assembly having a first cutting blade and a second cutting blade, said first cutting blade and said second cutting blade cooperating to sever at least one label from a linerless label media; and a cutter mount supporting said cutting assembly and being mountable to a printer, wherein said first cutting blade has a blade lubricator mounted thereto, said blade lubricator configured to lubricate at least one of said cutting blades wherein said cutter mount includes a base plate for supporting at least one of said first and second cutting blades, said base plate defining a cavity for receipt of said linerless label media.

10. The linerless label media cutting apparatus according to claim 9, said blade lubricator being biased against said first cutting blade.

11. The linerless label media cutting apparatus according to claim 9, said blade lubricator comprising a sponge-like pad.

12. The linerless label media cutting apparatus according to claim 11, said sponge-like pad including a silicone material.

13. A linerless label media cutting apparatus comprising:

a cutting assembly having a first cutting blade and a second cutting blade, said first cutting blade and said second cutting blade cooperating to sever at least one label from a linerless label media; and a cutter mount supporting said cutting assembly and being mountable to a printer, said cutter mount including a blade carrier for supporting said first cutting blade and a base plate for supporting said second cutting blade, wherein said base plate comprises a top member, a support member and a cantilever member, said top member and said cantilever member extending longitudinally from said support member in a substantially parallel orientation to define a cavity for receipt of said linerless label media.

14. The linerless label media cutting apparatus according to claim 13, wherein said top member has a blade lubricator mounted thereto, said blade lubricator configured to lubricate said cutting blades.

15. The linerless label media cutting apparatus according to claim 14, wherein said blade lubricator comprises a sponge-like pad.

16. The linerless label media cutting apparatus according to claim 15, wherein said sponge-like pad includes a silicone material.

17. A linerless label media cutting apparatus comprising:

a cutting assembly having a first cutting blade including a sharpened edge and a second cutting blade including a sharpened edge, said first cutting blade and said second cutting blade cooperating to sever at least one label from a linerless label media, said first cutting blade being actuatable relative to said second cutting blade;

a drive actuator assembly operatively associated with said first cutting blade;

a cutter mount including mounting structure configured for mounting and alignment of said cutter mount to a printer, said cutter mount further including a blade carrier supporting said first cutting blade and a base plate supporting said second cutting blade, said base plate comprising a top member, and a support member and a cantilever member, said cantilever member extending longitudinally from said support member in a substantially parallel orientation to define a cavity for receipt of said linerless label media, said top member having a blade lubricator mounted thereto, said blade lubricator including silicone; and a plasma coated input guide supported by said cutter mount adjacent said cutting assembly.

18. A method for preparing labels from linerless label media comprising the steps of:

providing linerless label media from a printer to a linerless label media cutting apparatus;

providing a linerless label media cutting apparatus adapted for receiving linerless label media from the printer, the apparatus including:

a cutting assembly having a first cutting blade and a second cutting blade, said first and second cutting blades cooperating to sever at least one label from said linerless media, and a cutter mount supporting said cutting assembly and being mountable to the printer, wherein said cutter mount includes a base plate for supporting at least one of said first and second cutting blades, said base plate defining a cavity for receipt of said linerless label media; and severing at least one label from said linerless label media.

19. The method for preparing labels from linerless label media according to claim 18, further including the step of presenting said label to a label applicator.

20. The method for preparing labels from linerless label media according to claim 18, wherein said first and second cutting blades sever a plurality of labels from said linerless label media.

* * * * *